US005428538A

United States Patent [19]

Ferri

[11] Patent Number: 5,428,538

[45] Date of Patent: Jun. 27, 1995

[54] SANDING CONTROL SYSTEM FOR RAILWAY VEHICLES

[75] Inventor: Vincent Ferri, Pittsburgh, Pa.

[73] Assignee: Westinghouse Air Brake Company, Wilmerding, Pa.

[21] Appl. No.: 743,956

[22] Filed: Aug. 12, 1991

[51] Int. Cl.[6] ..... B61H 7/00; B61H 7/12

[52] U.S. Cl. ..... 364/426.02; 364/426.01; 303/93; 303/95; 318/52; 180/197

[58] Field of Search ..... 364/426.05, 426.02, 364/426.01; 303/93, 95; 318/52; 180/197

[56] References Cited

U.S. PATENT DOCUMENTS

| | | | |
|---|---|---|---|
| 3,682,512 | 8/1972 | Malon et al. | 303/20 |
| 4,347,569 | 8/1982 | Allen, Jr. et al. | 364/426.03 |
| 4,431,227 | 2/1984 | Howell | 295/33 |
| 4,701,682 | 10/1987 | Hirotsu et al. | 318/52 |
| 4,799,161 | 1/1989 | Hirotsu et al. | 364/426.01 |
| 4,835,693 | 5/1989 | Smith et al. | 364/426.05 |
| 4,841,446 | 6/1989 | Leiber et al. | 364/426.01 |
| 4,896,090 | 1/1990 | Balch et al. | 318/52 |
| 4,924,395 | 5/1990 | Evans et al. | 364/426.02 |
| 4,936,610 | 6/1990 | Kumar et al. | 318/52 |
| 4,944,539 | 7/1990 | Kumar et al. | 364/426.03 |
| 4,950,964 | 8/1990 | Evans | 318/52 |
| 5,083,075 | 1/1992 | Sato et al. | 364/426.02 |
| 5,117,163 | 5/1992 | Sandberg | 364/426.03 |
| 5,209,551 | 5/1993 | Wood et al. | 303/95 |
| 5,248,926 | 9/1993 | Kotake et al. | 318/52 |

*Primary Examiner*—Kevin J. Teska
*Assistant Examiner*—Tyrone V. Walker
*Attorney, Agent, or Firm*—John B. Sotak

[57] ABSTRACT

An electronic sanding control system for enhancing the frictional adhesion existing between the track rail and the wheels of a railway vehicle by functionally controlling the energization and deenergization of a sanding magnet valve with a plurality of OR and AND logic gates and a sand control latch circuit.

13 Claims, 2 Drawing Sheets

SANDING CONTROL SYSTEM FOR RAILWAY VEHICLES

FIELD OF THE INVENTION

This invention relates to an electronic control system for applying sand to the contact surface between the rail and wheels of a railway vehicle, and more particularly to a locomotive sanding arrangement for automatically controlling the sanding of the track rails for enhancing wheel-rail adhesion during wheel slip and slide conditions as well as during penalty, emergency and service brake applications, and for manually controlling the sanding and overriding the automatic control.

BACKGROUND OF THE INVENTION

It has been found that when the pneumatic and/or dynamic brakes on a railway locomotive or train are applied, the amount of actual braking force must be carefully controlled in order to safely and effectively slow down and/or stop the railway train at the entrance of a signal block or at a station or the like. Under conditions of a clean dry rail, the wheel-rail friction or adhesion is usually sufficient to maintain wheel rotation under normal braking forces. However, oil, wet or other slippery substances on the rails can upset the wheel-rail friction so that during braking the force acting to keep the wheels rolling deteriorates to the point where wheel slip occurs. It will be appreciated that once the wheel starts to slip, it rapidly progresses to a slide condition in which a sudden wheel lockup occurs. It has also been found that under certain conditions, a penalty, an emergency and in some circumstances, a service braking application may result in a slipping condition which could rapidly and inevitably progress from slipping to sliding with a resultant wheel lockup which produces flat spots on the sliding wheel and tends to lengthen the stopping distance of the train. Moreover, the repair and replacement of worn or flat wheels is an item of great concern to the maintenance department of the railroad or transit operators. It is well known that sanding is an effective method for assuring that adequate adhesion exists between the wheels and rails during the braking of the railway vehicles. However, many of the previous sanding methods relied upon the intuition and judgement of the engineman or operator in the application of the sand. Even with the development of more sophisticated electrical and mechanical equipment, there is a need to improve the method and manner of sanding the rails to ensure the existence of adequate wheel-rail adhesion during the braking of the moving vehicles. Now with the advent or increased usage of microprocessors and minicomputers onboard of locomotives and transit vehicles, it is possible to effectively and efficiently control and prevent the wheels from slipping and/or sliding during the various types of brake applications.

OBJECTS AND SUMMARY OF THE INVENTION

Accordingly, it is an object of this invention to provide a new and improved sanding control system for railway vehicles.

Another object of this invention is to provide a unique logic and control arrangement for enhancing the friction forces between the rail and the wheel of a locomotive during adverse conditions by sanding.

A further object of this invention is to provide a novel sanding control arrangement for improving the wheel-rail adhesion during braking under poor rail conditions.

Yet another object of this invention is to provide an improved sanding system for controlling the application of sand to the track rails for assuring adequate friction adhesion at the point of surface contact between the rails and the wheels of a railway vehicle.

Still another object of this invention is to provide a sanding control system for enhancing the wheel-rail adhesion for a railway vehicle, comprising first means responsive to a wheel slip and a wheel slide condition as well as to an emergency, a penalty and a service brake application for initiating an automatic sanding operation, second means responsive to a zero speed condition for nullifying the automatic sanding operation, and third means responsive to an operator command for initiating a manual sanding operation.

Yet a further object of this invention is to provide a sanding control arrangement for improving wheel-rail adhesion for railway vehicles comprising, a five-input OR gate having a first input connected to a wheel slip terminal, a second input connected to a wheel slide terminal, a third input connected to an emergency brake terminal, a fourth input connected to a penalty brake terminal, and a fifth input connected to a service brake terminal, a two-input AND gate having one input connected to the output of the five-input OR gate and having another input connected to a zero speed terminal, a sand control latch circuit having a set terminal connected to the output of the two-input AND gate, a first two-input OR gate having one input connected to the zero speed terminal and having another input connected to a manual sand terminal, the sand control latch circuit having a reset terminal connected to the output of the first two-input OR gate, a second two-input OR gate having one input connected to the output of the sand control latch circuit and having another input connected to the manual sand terminal, and a sand magnet valve connected to the output of the second two-input OR gate.

DESCRIPTION OF THE DRAWINGS

The above objects and other attendant features and advantages will be more readily appreciated as the present invention becomes better understood by reference to the following detailed description when considered in conjunction with the accompanying drawings, wherein.

DETAILED DESCRIPTION OF THE INVENTION

Figure 1:
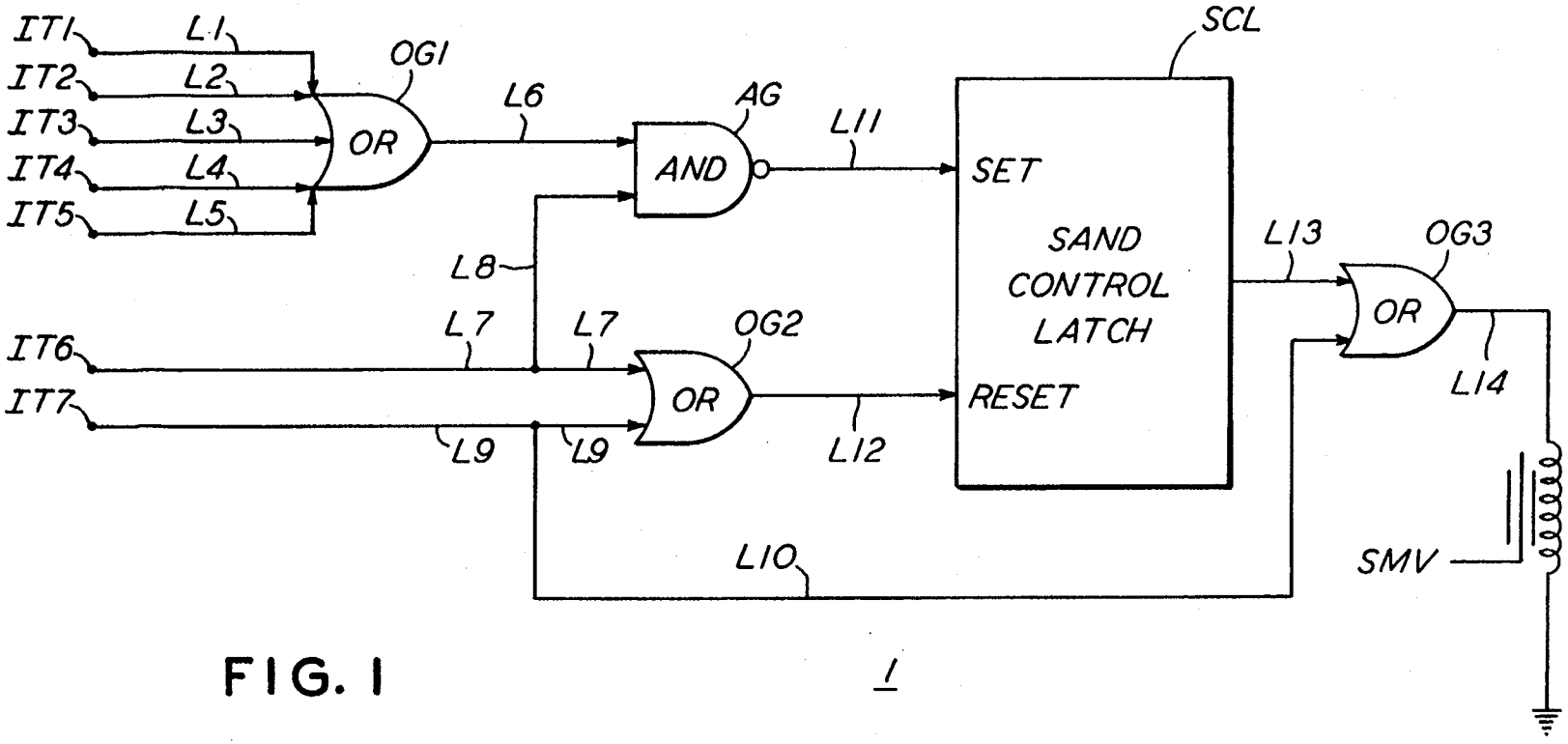
FIG. 1 is a schematic circuit diagram of a sanding control arrangement for applying sand to the rail for improving the friction adhesion between the surface of the rail and the wheel of a railway vehicle in accordance with the present invention.

Referring now to the drawings, and in particular to FIG. 1, there is shown a sanding control circuit, generally characterized by numeral 1, and including a plurality of logic networks OG1, OG2, OG3, and AG, and a sand control latch circuit SCL for controlling the electrical condition of a sanding magnet valve SMV. The sanding control system is capable of initiating the sanding of the track rail to improve wheel-rail adhesion under a number of different operation conditions. The sanding operation is automatically initiated during the occurrence of a wheel slip or slide condition and by the application of a penalty brake, an emergency brake, as well as a service brake of the railway vehicle. In addition, the sanding operation may be manually activated by the engineer or trainman who may close an electrical switch, or the like, which is conveniently located in the cab of the railway vehicle.

As shown in FIG. 1, a logic input signal is developed on a first terminal IT1 when a wheel slip indication condition is received from the wheel slip sensing and detecting equipment, while a logic input signal is developed on a second terminal IT2 when a wheel slide indication condition is received from the wheel slide sensing and detecting apparatus. A logic input signal is developed on a third terminal IT3 when a penalty brake control system is activated by the failure of the vehicle operator to indicate his alertness and/or well being by acknowledging a warning of an impending penalty brake application. It will be seen that a fourth terminal IT4 receives a logic input signal when an emergency brake application is made to stop the railway vehicles or train at the minimum distance possible. It will also be noted that a logic input signal indicative of a service brake application is conveyed to a fifth terminal IT5. The input signal indications conveyed to terminal IT1, IT2, IT3, IT4 and IT5 are fed to the inputs of the five-input OR gate circuit OG1 via leads L1, L2, L3, L4, and L5, respectively. As shown, the logic output signal of the OR gate OG1 is connected to one input of the two-input AND gate circuit AG via lead L6.

Further, as shown in FIG. 1, a zero (0) speed input signal is developed on a sixth input terminal IT6. The logic input signal appearing on terminal IT6 is derived from a zero speed sensor which indicates or signifys whether the vehicle is in a zero speed condition. In addition, it will be seen that a seventh terminal IT7 has a logic input signal which indicates whether a manual sand application has been initiated by the trainman or operator. It will be noted that the logic input signal appearing on terminal IT6 is conveyed to one input of the first two-input OR gate circuit OG2 via lead L7 and is also conveyed to the other input of the AND gate AG via lead L7 and L8. It will be observed that the logic input signal appearing on terminal IT7 is conveyed to the other input of the OR gate OG2 via lead L9 and is also conveyed to one input of the second two-input OR gate circuit OG3 via leads L9 and L10.

In viewing FIG. 1, it will be seen that the output of the AND gate AG is inverted as is signified by the inversion output circle. The inverted output signal of AND gate AG is connected to the SET input terminal of the sand control latch circuit SCL via lead L11. On the other hand, the output of the OR gate OG2 is connected to the reset input terminal of the latching circuit SCL via lead L12. The output of the sand control latching circuit is connected to the other input of the OR gate OG3 via lead L13. It will be noted that the output of the OR gate OG3 is connected by lead L14 to the coil of the sanding magnet valve SMV which controls the supply of fluid under pressure from a suitable sanding supply reservoir (not shown) to appropriate sanders of well known construction to effectively delivery sand to the track rails in front or ahead of the oncoming wheels of the locomotive or railway vehicle.

It will be appreciated that any one of inputs, namely, a logical "1", on terminals IT1, IT2, IT3, IT4, and IT5 will produce a logical "1" on output lead L6 which is conveyed to one input of AND gate AG. When the railway vehicle is not at a zero speed condition, a logical "0" is developed on terminal IT6 and is conveyed to the other input of AND gate AG via leads L7 and L8. Thus, the AND gate AG outputs a logical "0" during the presence of a logical "1" and a logical "0" input. However, the logical "0" output is inverted and a logical "1" is developed on lead L11 which sets the sand control latch circuit SCL to produce a logical "1" on lead L13. Thus, the OR gate OG3 outputs a logical "1" which is effective in energizing the sanding magnet valve SMV to cause the sanding of the track rail to enhance the wheel-rail adhesion for the moving railway vehicle.

Now when the railway vehicle reaches a zero speed condition, the signal on terminal IT6 becomes a logical "1" which is conveyed to the other input of AND gate AG via leads L7 and L8. The presence of two logical "1" inputs causes the AND gate AG to output a logical "1". However, the logical "1" output is inverted so that a logical "0" is conveyed to the SET terminal of sand control latch circuit SCL. It will be seen that the logical "1" on terminal IT6 is also applied to one input of the OR gate OG2 via lead L7 which in turn produces a logical "1" on lead L12. The logical "1" on lead L12 resets the sand control latch circuit SCL so that it outputs a logical "0" on lead L13. If no manual sand application is requested by the engineer, the signal on input terminal IT7 will be logical "0" so that both inputs to OR gate OG3 are a logical "0", and therefore the output of the OR gate OG3 will be a logical "0" which will effectively deenergize the sanding magnet valve SMV. On the other hand, if the engineer initiates a sanding request, a logical "1" will appear on input terminal IT7. The logical "1" input signal is conveyed to the input of the OR gate OG3 via leads L9 and L10. Thus, the OR gate OG3 outputs a logical "1" which effectively causes the energization of the sanding magnet valve SMV so that sand is spread over the head of the track rail to improve the wheel-rail adhesion.

Figure 2:
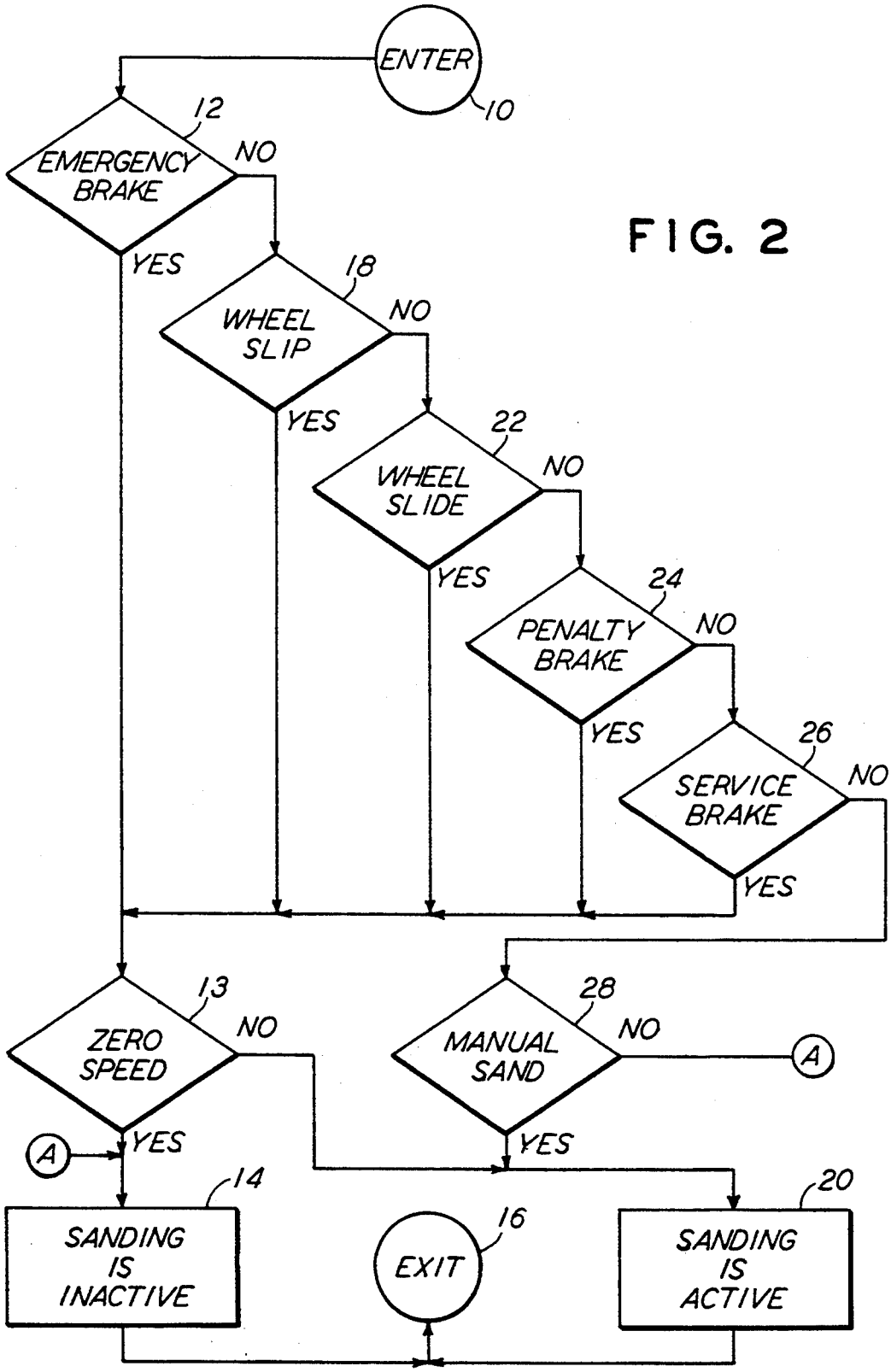
FIG. 2 is a flow chart which explains the operation of the sanding control system of FIG. 1 including a microprocessor.

In further describing the operation of the sanding control system of FIG. 1, it will be useful and beneficial to refer to the flow diagram of FIG. 2 which illustrates the program steps that are followed in determining whether sanding of the track rail is necessary or is not necessary in order to effectively slow down and/or stop the railway vehicle. The sequence of operation is initiated by an enter signal eminating from the enter block 10. The first step is determined in decision block 12 which resolves if the railway vehicle is in an emergency brake application. If the answer is "YES" the program advances to the next step 13 which determines if the railway vehicle is at zero speed. If the railway vehicle is stopped, the output from the zero speed decision block 13 is "YES" so that the "sanding is inactive" block 14 which ensures that the sanding magnet valve SMV remains deenergized and the program is terminated at exit block 16.

Returning now to the emergency brake decision block 12, it will be seen that a "NO" signal is outputted by the emergency brake block 12 when no emergency condition is in effect. Thus, the "NO" signal is conveyed to the wheel slip decision block 18 which determines if a brake wheel slip condition is present on the railway vehicle. If a wheel slip condition is present, a "YES" signal is conveyed to the zero speed decision block 13. Since a wheel slip condition cannot occur when the railway is stopped, the zero speed decision block outputs a "NO" to the "sanding is active" block 20 which initiates a sanding operation of the track rail by energizing the sanding magnet valve SMV and the program is terminated at exit block 16.

Returning again to wheel slip block 18, it will be seen that, if no wheel slip is present, a "NO" signal is conveyed to the wheel slide decision block 22. If the railway vehicle is in a wheel slip condition, the wheel slide decision block 22 will output a "YES" signal which is conveyed to the zero speed decision block 12. Since a wheel slide condition can only occur on a moving railway vehicle, the zero speed decision block 13 will output a "NO" signal which is conveyed to the sanding is active block 20 which commences a sanding operation by activating the sanding magnet valve SMV and the program is ended at the exit block 16.

Again returning to the wheel slide decision block 22, it will be appreciated that, if no wheel slide condition is present, a "NO" signal is supplied to the penalty brake decision block 24. If the railway vehicle is in a penalty brake situation, a "YES" signal is conveyed to the zero speed decision block 13. Since a penalty brake condition can only occur during movement of the railway vehicle, the zero speed decision block 13 will output a "NO" signal to the "sanding is active" block 20 which initiates the sanding of the track rail to improve the wheel-rail adhesion by energizing the sanding magnet valve SMV, and the program is terminated at exit block 16.

Now if a penalty brake is not present, the penalty brake decision block 24 outputs a "NO" signal which is conveyed to the service brake block 26. If the railway vehicle is in a service brake mode of operation, a "YES" signal is conveyed to the zero speed decision block 13 which outputs a "NO" signal to the sanding is active block 20. The block 20 initiates a sanding operation to enhance the wheel-rail adhesion during the braking of the moving vehicle, and the program is terminated at exit block 16.

It will be appreciated that, if none of the five (5) conditions, namely, emergency brake, wheel slip, wheel slide, penalty brake and service brake prevail, the trainman or engineer may exercise the prerogative of either sanding or not sanding the track rail. If the engineer does not want sand, the manual sand decision block 28 will output a "NO" signal on terminal A which is conveyed to the "sanding is inactive" block 14. Thus, the sanding magnet valve SMV is deenergized and the program is terminated at exit block 16. On the other hand, if the engineer through intuition or the like desires to initiate a sanding operation, the manual sand decision block 28 will output a "YES" signal which is conveyed to the "sanding is active" block 20. The block 20 commences a sanding operation by energizing the sanding magnet valve SMV which dispenses sand on track rail to ensure that adequate frictional adhesion exists between the running surface of the track rails and the tread of the wheels of the railway vehicle. The program is terminated at exit block 20. Thus, it will be seen that automatic sanding is readily actuated under certain operating conditions and manual sanding may be left to the discretion and experience to the engineer of the locomotive or train.

Thus, the present invention has been described in such full, clear, concise, and exact terms as to enable any person skilled in the art to which it pertains to make and use the same, and having set forth the best mode contemplated of carrying out this invention. We state that the subject matter, which we regard as being our invention, is particularly pointed out and distinctly asserted in what is claimed. It will be understood that various alterations and changes may be made by those skilled in the art without departing from the spirit and scope of the subject invention. Further, with the advent of microprocessors and minicomputers, it is evident that the various functions and operations may be carried out and processed by a suitably programmed computer which receives the different inputs and produces the appropriate outputs. Therefore, it will be appreciated that certain modifications, ramifications, and equivalents will be readily apparent to persons skilled in the art and accordingly it is understood that the present invention should not be limited to the exact embodiment shown and described, but should be accorded the full scope and protection of the appended claims.

What I claim is:

1. A sanding control system for enhancing the wheel-rail adhesion for a railway vehicle comprising first means responsive to a wheel slip and a wheel slide condition as well as to an emergency, a penalty and a service brake application for initiating an automatic sanding operation, second means connected to said first means and responsive to a zero speed condition for nullifying the automatic sanding operation, and third means responsive to an operator command for initiating a manual sanding operation, said third means includes a two-input OR gate circuit connected to receive said zero speed condition and said operator command as inputs of said two-input OR gate circuit.

2. The sanding control system for enhancing the wheel-rail adhesion for a railway vehicle as defined in claim 1, wherein said first means includes a five-input OR gate circuit.

3. The sanding control system for enhacing the wheel-rail adhesion for a railway vehicle as defined in claim 1, wherein said second means includes a two-input AND gate circuit.

4. The sanding control system for enhancing the wheel-rail adhesion for a railway vehicle as defined in claim 1, wherein a sand control latch circuit is set by said first means and is reset by the zero speed condition and by the operator command.

5. The sanding control system for enhancing the wheel-rail adhesion for a railway vehicle as defined in claim 1, wherein said sanding control system further includes a sanding magnet valve which is energized to initiate the automatic and manual sanding operation.

6. The sanding control system for enhancing the wheel-rail adhesion for a railway vehicle as defined in claim 3, wherein the output of said two-input AND gate circuit is connected to a set terminal of a sand control latch circuit.

7. The sanding control system for enhancing the wheel-rail adhesion for a railway vehicle as defined in claim 6, wherein the output of said two-input AND gate circuit is inverted.

8. A sanding control arrangement for improving wheel-rail adhesion for railway vehicles comprising, a five-input OR gate having a first input connected to a wheel slip terminal, a second input connected to a wheel slide terminal, a third input connected to an emergency brake terminal IT4, a fourth input connected to a penalty brake terminal, and a fifth input connected to a service brake terminal, a two-input AND gate having one input connected to the output of said five-input OR gate and having another input connected to a zero speed terminal, a sand control latch circuit having a set terminal connected to the output of said two-input AND gate, a first two-input OR gate having one input connected to said zero speed terminal and having another input connected to a manual sand terminal, said sand control latch circuit having a reset terminal connected to the output of said first two-input OR gate, a second two-input OR gate having one input connected to the output of said sand control latch circuit and having another input connected to said manual sand terminal, and a sand magnet valve connected to the output of said second two-input OR gate for automatically controlling the sanding of track rails and alternatively for manually controlling the sanding of the track rails and overriding the automatic control.

9. The sanding control arrangement for improving wheel-rail adhesion for a railway vehicle as defined in claim 8, wherein said output of said two-input AND gate undergoes an inversion.

10. The sanding control arrangement for improving wheel-rail adhesion for a railway vehicle as defined in claim 8, wherein a logical "1" signal developed on any of said first, second, third, fourth, and fifth input terminals represents a request for initiating an automatic sanding operation.

11. The sanding control arrangement for improving wheel rail adhesion for a railway vehicle as defined in claim 8, wherein a logical "1" signal developed on said zero speed terminal will nullify the automatic sanding operation.

12. The sanding control arrangement for improving wheel-rail adhesion for a railway vehicle as defined in claim 8, wherein a logical "1" signal developed on said manual sand terminal represents a request for a manual sanding operation.

13. The sanding control arrangement for improving wheel-rail adhesion for a railway vehicle as defined in claim 8, wherein said sanding magnet valve is energized when said second two-input OR gate receives a logical "1" input signal from said sand control latch circuit and/or from said manual sand terminal.

* * * * *